United States Patent [19]

Mikulas, Jr. et al.

[11] Patent Number: 4,557,097

[45] Date of Patent: Dec. 10, 1985

[54] SEQUENTIALLY DEPLOYABLE MANEUVERABLE TETRAHEDRAL BEAM

[75] Inventors: Martin M. Mikulas, Jr., Williamsburg, Va.; Robert F. Crawford, Santa Barbara, Calif.

[73] Assignee: The United States of America as represented by the Administrator of the National Aeronautics and Space Administration, Washington, D.C.

[21] Appl. No.: 530,339

[22] Filed: Sep. 8, 1983

[51] Int. Cl.[4] ..... E04H 12/18

[52] U.S. Cl. ..... 52/646; 52/632; 52/637; 52/648; 16/242; 16/390; 403/64; 403/171

[58] Field of Search ..... 182/178, 179; 403/64, 403/171, 176, 49; 16/242, 254, 365, 382, 384, 387, 389, 390; 52/116, 117, 118, 121, 632, 637, 646, 648, 721, 654, 655; 14/14

[56] References Cited

U.S. PATENT DOCUMENTS

| | | | |
|---|---|---|---|
| 2,559,741 | 7/1951 | Wachsmann | 14/14 |
| 3,221,464 | 12/1965 | Miller | 52/655 |
| 3,332,195 | 7/1967 | Foster | 52/646 |
| 3,354,596 | 11/1967 | Schafer | 52/695 |
| 3,486,279 | 12/1969 | Webb et al. | 52/646 |
| 3,593,481 | 7/1971 | Mikulin | 52/117 |
| 3,634,989 | 1/1972 | Rogers | 52/637 |
| 3,771,274 | 11/1973 | Vaughan | 52/646 |
| 3,830,031 | 8/1974 | Soisson | 52/648 |
| 3,913,105 | 10/1975 | Williamson et al. | 52/646 |
| 4,017,932 | 4/1977 | Lotto et al. | 52/646 |
| 4,069,832 | 1/1978 | Bingham | 52/648 |
| 4,111,574 | 9/1978 | Runyon | 403/54 |
| 4,115,975 | 9/1978 | Bliss | 52/646 |
| 4,450,851 | 5/1984 | Beavers | 403/64 |

FOREIGN PATENT DOCUMENTS

| | | | |
|---|---|---|---|
| 848670 | 8/1970 | Canada | 52/650 |

*Primary Examiner*—John E. Murtagh
*Assistant Examiner*—Andrew Joseph Rudy
*Attorney, Agent, or Firm*—Howard J. Osborn; Wallace J. Nelson; John R. Manning

[57] ABSTRACT

The invention relates to a tetrahedral beam that can be compactly stowed, sequentially deployed, and widely manipulated to provide a structurally sound yet highly maneuverable truss structure. The present beam is comprised of a plurality of repeating units comprised of tandem tetrahedra sharing common sides. Tetrahedra are comprised of fixed length battens 12 joined by joint 14 into equilateral triangles called batten frames. Apexes of adjacent triangles are interconnected by longerons 16 having mid-point folding hinges 20. Joints 14 are comprised of gussets 24,34 pivotably connected by links 25. Joints 14 permit two independent degrees of rotational freedom between joined adjacent batten frames, and provide a stable structure throughout all stages of beam deployment, from packaged configuration to complete deployment. The longerons and joints can be actuated in any sequence, independently of one another. The present beam is well suited to remote actuation. Longerons 16 may be provided with powered mid-point hinges **20*a* enabling beam erection and packaging under remote control. Providing one or more longerons 16 with powered telescoping segments 16*a*** permits the shape of the beam central axis to be remotely manipulated so that the beam may function as a remote manipulate arm.

6 Claims, 9 Drawing Figures

SEQUENTIALLY DEPLOYABLE MANEUVERABLE TETRAHEDRAL BEAM

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

The present invention relates generally to deployable truss structures and more specifically to a tetrahedral beam that can be compactly stowed, sequentially deployed, and widely manipulated to provide a structurally sound yet highly maneuverable truss structure.

The Space Shuttle Transportation System developed by the National Aeronautics and Space Administration has greatly facilitated the research and development of both small and large space structures. Projects presently under consideration include extremely large antennae for communications or Earth surveillance, orbital laboratories, and space-based manufacturing facilities. These missions will be characterized by a need for linear structural members, such as the tetrahedral beam, which are automatically deployable and capable of varying geometry during use.

A variety of expandable and deployable structures for both space and terrestrial applications are found in the prior art. Hedgepeth et al (U.S. Pat. No. 4,334,391) discloses a deployable lattice column comprised of longerons connected together by diagonals and battens. The column can be compactly packaged, then erected into a structurally sound column. Additionally, the column employs redundant structural members to preserve integrity should some elements fail.

Although the Hedgepeth column, as well as many others, have enjoyed commercial success, a deployable column which is maneuverable in a direction other than along its axis has yet to be demonstrated. None of the deployable beams found in the prior art are capable of varying the shape of their axes so as to function, for example, as a remote manipulator arm. Manipulator arms presently in use are designed to resemble human arms; they have rigid sections connected by flexible joints. Such manipulator arms do not provide the strong, stable structure provided by the present deployable and manipulatable tetrahedral beam structure.

It is therefore an object of the present invention to provide a novel structural column comprised of repeating units of tandem tetrahedra.

It is a further object of the present invention to provide a novel joint for flexibly joining tetrahedral beam structural members.

Another object of the present invention is to provide a tetrahedral beam which can be compactly packaged and remotely deployed.

An additional object of the present invention is to provide a deployable beam that does not require a separate canister or deployer.

Yet another object of the present invention is to provide a tetrahedral beam capable of widely varying the shape of its central axis so as to enable it to function as a remotely controlled manipulator arm.

A further object is to provide a stable beam comprised of fewer structural members per unit length than prior art truss beams.

BRIEF SUMMARY OF THE INVENTION

According to the present invention, the foregoing and other objects are attained by forming a tetrahedral truss beam comprised of a series of interconnected tetrahedra. Two tandem tetrahedra sharing common sides comprise the repeating unit of the present beam; a plurality of repeating units can be interconnected by the novel joint disclosed herein to form a beam of desired length.

The present beam compactly packages into a generally triangular solid about one-fourteenth as long as the extended beam. Longeron structural members can be remotely actuated by appropriate state of the art means to sequentially deploy the beam from the packaged geometry, as well as to operate the beam as a remote manipulator arm. The present joint design constitutes a stable linkage system throughout the entire range of deployment, from packaged configuration to complete deployment.

BRIEF DESCRIPTION OF THE DRAWINGS

A more complete appreciation of the invention and many of the attendant advantages thereof will be more clearly understood by reference to the following detailed description when considered in connection with the accompanying drawings, wherein.

DETAILED DESCRIPTION OF THE INVENTION

Figure 1:
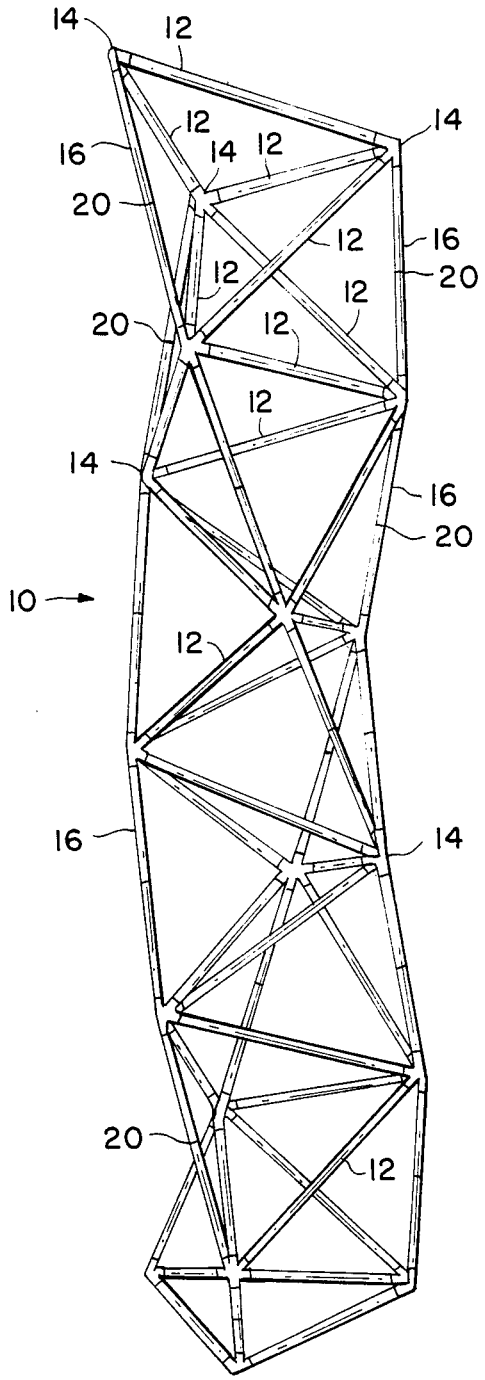
FIG. 1 is a view of an exemplary tetrahedral beam of the present invention.

Referring now to the drawings wherein like reference numerals designate identical parts throughout the several views, and more particularly to FIG. 1, there is shown a tetrahedral beam constructed in accordance with the present invention and designated by reference numeral 10. Tetrahedral beam 10 is constructed of a plurality of identical, fixed length battens 12. Battens 12 may be fabricated of tubular aluminum, composite, or other strong yet lightweight material. Joints 14 as described in detail later join battens 12 and longeron members 16. Longerons 16 include folding hinges 20 at longeron mid-points. As can be seen in FIG. 1, the beam is comprised of repeating units comprised of tandem tetrahedra. Adjacent tetrahedra share common sides as a beam of desired length is assembled of an appropriate number of repeating tandem tetrahedral units joined by joints 14. In the interest of clarity, joints 14 have not been drawn in detail in FIG. 1, but are fully described below and in subsequent FIGS.

Figure 2:
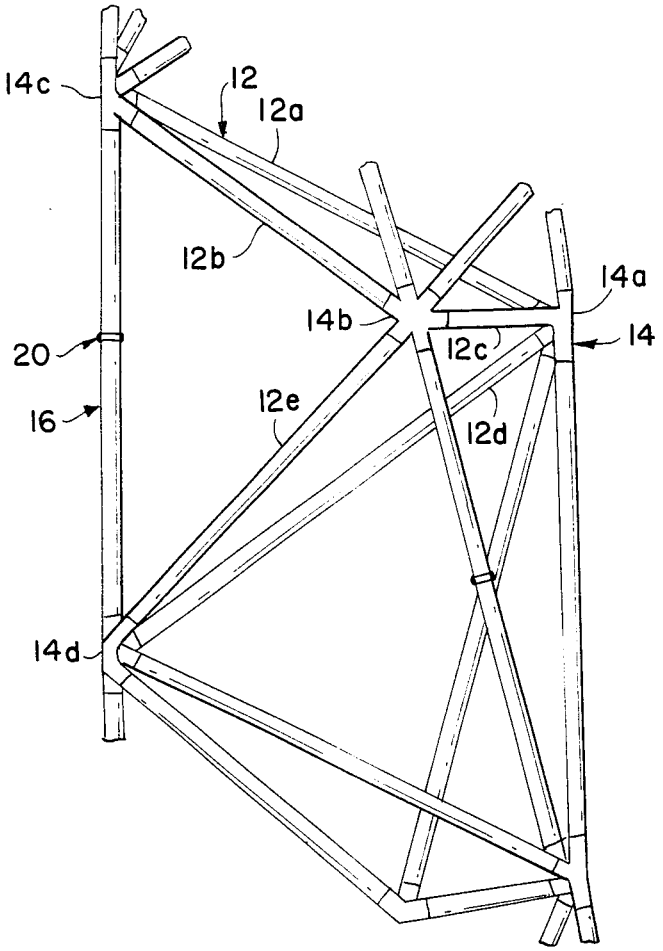
FIG. 2 is a view of one repeating unit of the present beam.

By referring to FIG. 2 (which depicts one repeating unit of tandem tetrahedra as well as partial views of several members of adjoining repeating units), the basic construction of the present beam may be more readily appreciated. Battens 12*a*, 12*b*, 12*c*, joined by joints 14*a*, 14*b*, 14*c* form an equilateral triangle herein referred to as a batten frame. A second batten frame is formed of battens 12*c*, 12*d*, 12*e* joined by joints 14*a*, 14*b*, 14*d*. The apexes of these two batten frames, at joints 14*d*, 14*c*, are held apart and interconnected by hinged longeron 16 thus, it is readily apparent that the two batten frames have a "common base batten" 12C. Longeron 16 is hinged at its mid-point by hinge 20 to enable compact packaging of the beam, as will be hereinafter described. In the interest of clarity, joints 14 have not been illustrated in fine detail in FIGS. 1–3, but will be hereafter completely disclosed by further reference to this specification and the accompanying drawings.

Figure 3:
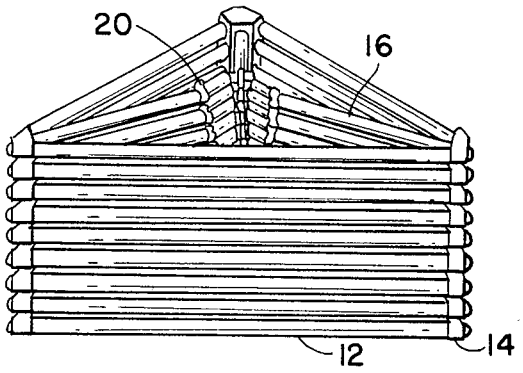
FIG. 3 is a view of the folded configuration of the present invention.

Referring now to FIG. 3, tetrahedral beam 10 of the present invention is depicted in folded configuration. Batten frames now lie on parallel planes in a stacked configuration with battens 12 stacked on top of other battens and joints 14 stacked on joints. Longerons 16 have completely folded about their mid-point hinges 20 and are stacked in the interior of the triangular solid formed by the stacked batten frames. When completely folded as in FIG. 3 the present beam continues to provide a stable structure, and does not require a canister or other external packaging. The present packaging geometry is extremely efficient, as the folded length of the beam is only one-fourteenth as long as the fully deployed beam (FIG. 1).

To provide a tetrahedral beam with the ability to be maneuvered and compactly packaged, a novel joint designated generally by reference numeral 14, and shown in FIGS. 4–7, was constructed. Joint 14 is comprised essentially of gusset 24 connected to gusset 34 by link 25. Link 25 permits gusset 34 to swivel about gusset 24 with two degrees of freedom as follows. First from a folded position in which gussets 34,24 lie on parallel planes (FIG. 4), gusset 34 swivels counterclockwise about batten 12*f*, to any desired angle, while link 25 and gusset 24 remain fixed. Secondly, link 25 swivels about the end of batten 12*i* which protrudes from gusset 24. In this latter swiveling, gusset 34 rotates along with link 25 to any other desired angle. These two rotational degrees of freedom thus permit each corner to deploy to any desired angle, independently of other corners. The beam axis may be straight or crooked when deployed, depending on whether all joints are deployed equally or unequally, respectively.

Figure 4:
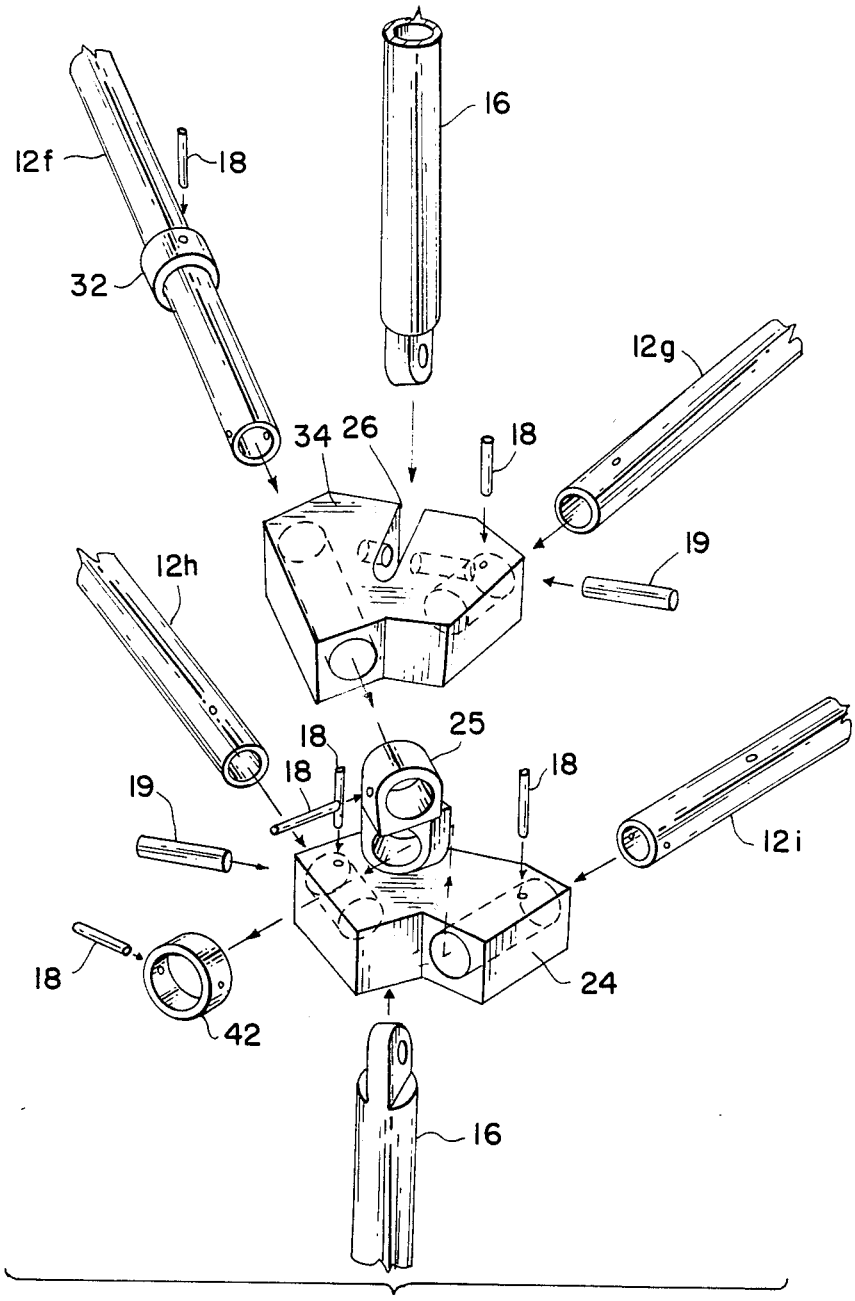
FIG. 4 is an exploded view of the novel joint of the present invention.

Referring now to FIG. 4, an exploded view of joint 14, the structure of joint 14 can be readily appreciated. Battens 12*f*, and 12*g* are joined by gusset 34. Batten 12*g* is fixed within gusset 34 by keeper pin 18, but batten 12*f* is free to rotate (swivel) within gusset 34. Collar 32 with a keeper pin 18 retains batten 12*f* within gusset 34 from one direction. Link 25 and keeper pin 18 retains batten 12*f* within gusset 34 from the other direction. A longeron 16 is pivotably mounted in slot 26 by hinge pin 19.

A second gusset 24 joins battens 12*h*, 12*i*. Batten 12*h* is fixed within gusset 24 by keeper pin 18. Batten 12*i* is also fixed within gusset 24 with a keeper pin 18. Link 25 swivels about batten 12*i* and is retained from slipping off batten 12*i* by gusset 24, retaining collar 42, and a keeper pin 18. A longeron 16 is pivotably mounted by a hinge pin 19 in a slot (not shown) in gusset 24.

Link 25 serves to pivotably join gussets 24,34. Batten 12*i* of gusset 24 passes through an aperture of link 25 and is secured by retaining collar 42 with a keeper pin 18. Batten 12*f* of gusset 34 passes through a second aperture of link 25 and is secured therein by a keeper pin 18. Throughout FIGS. 5–9 and the accompanying specification, the operation and structure of various parts of joint 14 will be further detailed.

Figure 5:
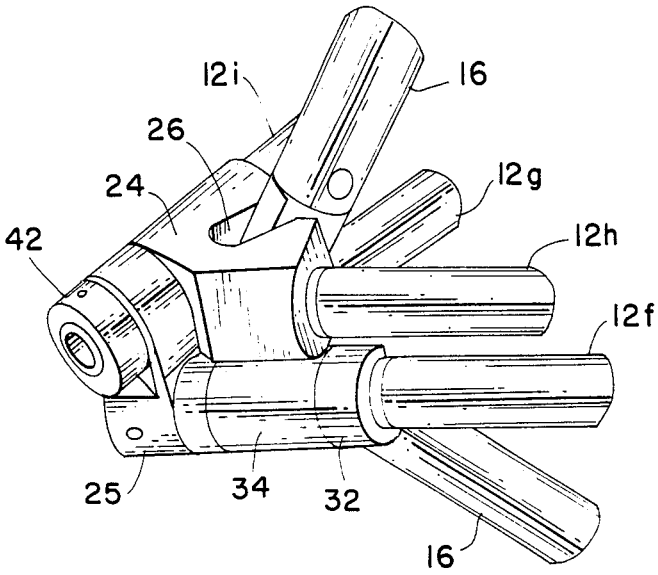
FIG. 5 is a view of the novel joint of the present beam in a folded configuration.

Referring now to FIG. 5, joint 14 is depicted in completely folded configuration. Gussets 24, 34 lie on parallel planes, as do all battens 12*f*, 12*g*, 12*h*, and 12*i*. Longerons 16 have been illustrated as deflected from their folded position in which they would be parallel to battens 12 to illustrate that longerons are free to pivotally deflect even when gussets 24, 34 are folded. As seen in FIG. 5, gusset 24 fixedly joins battens 12*h* and 12*i* in a 60° angular relationship. Gusset 24 contains a slot 26 in which longeron 16 is pivoted by a simple hinge. Link 25 circumferentially surrounds batten 12*i* between gusset 24 and collar 42. Gusset 24 along with link 25 is free to rotate about batten 12*i*.

Figure 6:
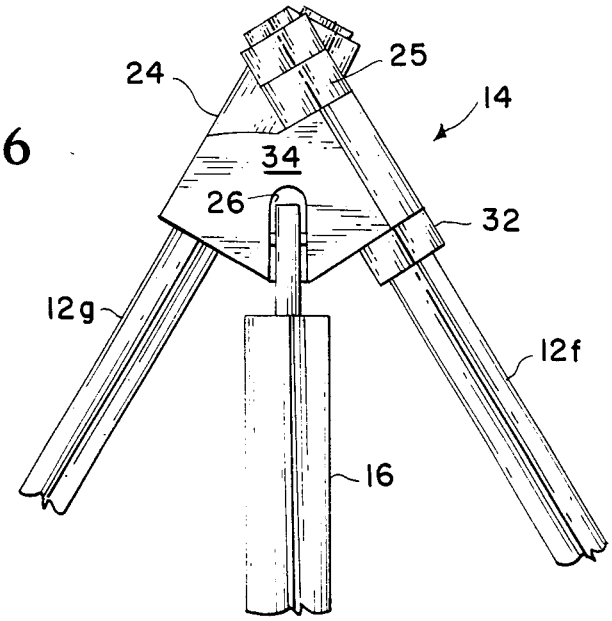
FIG. 6 is a partial view of the novel joint of the present beam.

Referring now to FIG. 6, further details of joint 14 are illustrated. Gusset 34 is circumferentially disposed about the shaft of batten 12*f* between collar 32 and link 25 and rotates about the shaft of batten 12*f*, the end of which protrudes through gusset 34. Batten 12*g* is fixedly disposed within gusset 34 at a 60° angular relationship to batten 12*f*. Longeron 16 is pivotally disposed within slot 26 of gusset 34 such that longeron 16 bisects the angle formed by battens 12*f*, 12*g*. In the interest of clarity, further components of joint 14 have been omitted from FIG. 6 but are described below.

Figure 8:
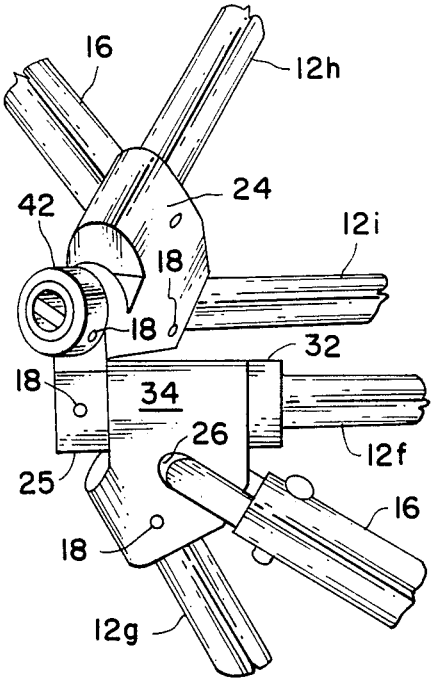
FIG. 8 is a view of the novel joint of the present invention in a fully deployed configuration.
Figure 7:
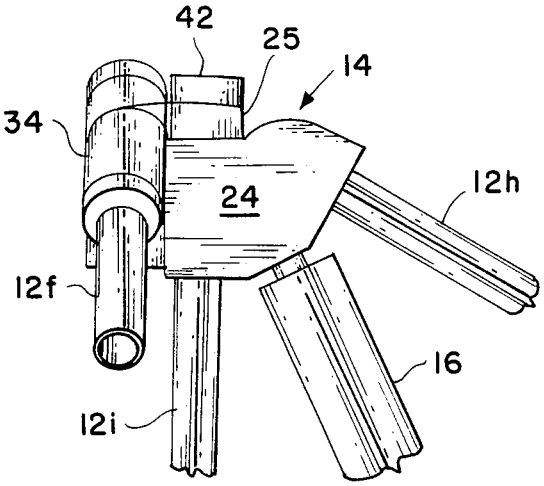
FIG. 7 is a view of the novel joint of the present invention in a partially deployed configuration.

Referring to FIG. 7, gusset 24 is shown with battens 12*h*, 12*i* fixedly attached thereto and forming a 60° angular relationship. Gusset 34 is depicted as having rotated about batten 12*i* relative to the folded configuration of FIG. 4. Gusset 34 has rotated about batten 12*i* via link 25 which is circumferentially disposed around batten 12*i* between gusset 24 and collar 42. Referring now to FIG. 8, joint 14 is shown in its completely unfolded or deployed configuration. Gusset 34 has further rotated about batten 12*f*, as well as about batten 12*i* via link 25.

Figure 9:
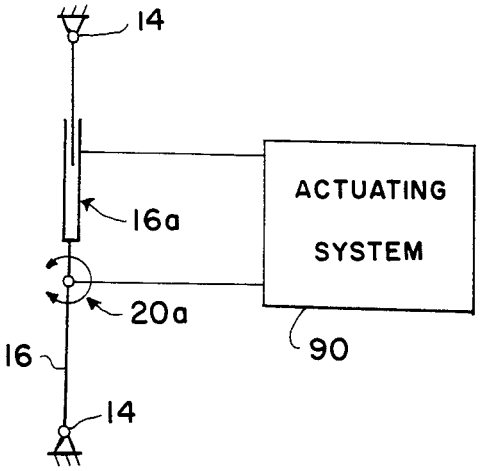
FIG. 9 is a schematic view of the powered activating members of the present beam.

In the preferred embodiment, tetrahedral beam 10 is powered by suitable state-of-the-art actuators to deploy and retract the longerons and to thus provide a beam capable of acting as a remotely controlled manipulator arm. To first provide the capability of powered erection, longerons 16 are provided with powered elbow-type hinges 20*a* as schematically depicted in FIG. 9. Such hinges are known in the art and commonly employ an electric motor driven worm gear to drive a spur gear, thereby folding and unfolding the longeron. To provide the ability to vary the shape of the beam central axis, one or more longerons 16 are equipped with powered telescoping segments 16*a*. Telescoping tubular segments driven by electric, hydraulic and pneumatic means are well known in the art. Electric powered automobile radio antennae provide an excellent example of telescoping segments suitable for actuating the present beam. In the embodiment schematically depicted in FIG. 9, one-half of longeron 16 is comprised of telescoping segments 16*a*. The other half of longeron 16 is comprised of a fixed length tubular segment. An actuating system 90 to provide power to and suitable control over powered hinges 20*a* and telescoping longeron segments 16*a* is also schematically depicted in FIG. 8. Although both longeron halves could be equipped with telescoping segments 16*a*, the depicted embodiment retains much maneuverability. Although all longerons 16 of the present beam could be equipped with powered telescoping segments 16*a*, one-half of the longerons 16, or fewer, could be so equipped and still render a highly maneuverable beam.

OPERATION

Operation of the present beam should now be apparent. From a fully packaged configuration (FIG. 3) the present beam 10 is erected by unfolding longerons 16. In the powered embodiment this is accomplished by operating the actuating system 90 (FIG. 9) which provides electrical power to powered hinges 20*a*. Each powered hinge 20*a* is provided with a separate control switch, thus the beam may be sequentially deployed by powering successive powered hinges 20*a*. Once erected, the beam may be maneuvered as desired by selectively powering individually powered telescoping segments 16*a*, to lengthen or shorten longerons 16, with the actuating system 90 (FIG. 9). To collapse the beam, powered telescoping segments 16*a* are returned to their neutral position with the actuating system 90, after which powered hinges are operated to sequentially collapse the beam in reverse order of erection.

Although the invention has been described relative to specific embodiments it is not so limited and many modifications and variations thereof will be readily apparent to those skilled in the art in light of the above teachings. For example, a combination folding hinge and telescoping members in place of respective hinge 20*a* and telescoping members 16*a*, with appropriate power and control means, could be employed.

What is claimed as new and desired to be secured by Letters Patent is:

1. A highly maneuverable and fully collapsible tetrahedral beam comprised of a plurality of interconnected tetrahedral, each tetrahedron including:

(a) five fixed length battens;

(b) joint means joining said battens into batten frames to form two equilateral triangles and providing two rotational degrees of freedom at each joint;

(c) two batten frames sharing a common base batten; and (d) a longeron connecting each of the apexes of said batten frames, said longeron including a foldable hinge at its mid-point and being pivotally hinged at its ends to said joint means.

2. A fully collapsible tetrahedral beam as in claim 1 including means for independently inducing movement of said joint means relative to other joints in said tetrahedral beam.

3. A fully collapsible tetrahedral beam as in claim 1 wherein said joint means includes:

(a) a first gusset maintaining two battens in a fixed 60° relationship and pivotably hinging a longeron located as to bisect said 60° angle;

(b) a second gusset maintaining two battens in a fixed 60° relationship and pivotably hinging a longeron located as to bisect said 60° angle; and (c) a link pivotably connecting said first gusset and said second gusset to form a joint assembly such that said upper gusset and said lower gusset pivot to provide two degrees of rotational freedom at each joint assembly whereby, said joint assembly can be folded or actuated independently of and in any sequence relative to other joints of the tetrahedral beam permitting the tetrahedral beam to deploy to any desired position.

4. A fully collapsible tetrahedral beam as in claim 1 wherein said foldable hinge is electrically powered.

5. A fully collapsible tetrahedral beam as in claim 1 wherein said longeron contains telescoping segments.

6. A fully collapsible tetrahedral beam as in claim 4 including power means for inducing telescoping movement of said telescoping segments, said power means being selected from hydraulic, pneumatic and electrical power means.

* * * * *